US005470445A

United States Patent [19]

Murray et al.

[11] Patent Number: 5,470,445

[45] Date of Patent: Nov. 28, 1995

[54] ELECTRODE CAP WITH INTEGRAL TANK COVER FOR ACID MIST COLLECTION

[75] Inventors: James A. Murray, Walnut Creek; Michael R. Nees, Clayton; William P. Imrie, Layfayette; Christopher C. Rayner, Alamo; Chris L. Pfalzgraff, Concord; Robert K. Bates, San Ramon, all of Calif.; Valmer H. Ness, Highlands Ranch, Colo.; Terrance J. Cox, San Francisco, Calif.

[73] Assignee: Bechtel Group, Inc., San Francisco, Calif.

[21] Appl. No.: 226,785

[22] Filed: Apr. 12, 1994

Related U.S. Application Data

[63] Continuation-in-part of Ser. No. 978,945, Nov. 29, 1992, abandoned.

[51] Int. Cl.[6] ..... C25C 7/06

[52] U.S. Cl. ..... 204/105 R; 204/106; 204/278; 204/279; 204/288; 204/289

[58] Field of Search ..... 204/270, 278, 204/289, 106, 105 R, 279, 288

[56] References Cited

U.S. PATENT DOCUMENTS

| | | | |
|---|---|---|---|
| 4,668,353 | 3/1987 | Smith | 204/129 |
| 5,149,411 | 9/1992 | Castle | 204/237 |

OTHER PUBLICATIONS

Invention Deisclosure, "Oxide Tankhouse Anodes", Magma Copper Company, Apr. 26, 1985.

Magma Copper Company Interoffice Correspondence, "Oxide Tankhouse Anodes" M. F. Vancas, Apr. 26, 1985 (unpublished).

*Primary Examiner*—John Niebling
*Assistant Examiner*—Brendan Mee
*Attorney, Agent, or Firm*—Townsend and Townsend and Crew

[57] ABSTRACT

In a tank confined electrolysis process, such as electrowinning or electrorefining, having circulated electroplating solution containing sulfuric acid, a multi-element cover system is applied below the electrode conductor connections and above the surface of the electrolyte bath. This cover is evacuated in the interstices below the cover and above the bath at a rate exceeding the stoichiometric ratio causing any leakage to occur into the volume overlying the bath thereby preventing acid aerosol from escape. The rate of evacuation is restricted so that humidity is maintain under the cover and over the surface of the bath to prevent the formation of crystals formed from aerosol droplets which become supersaturated. In a preferred embodiment, a circular weir in combination with gas discharge over the weir to a downcomer is disclosed. Entrainment of air over the weir and into the downcomer is disclosed to provide sufficient pumping for evacuation.

58 Claims, 10 Drawing Sheets

ELECTRODE CAP WITH INTEGRAL TANK COVER FOR ACID MIST COLLECTION

This application is a Continuation-in-Part of U.S. patent application Ser. No. 07/978,945 filed Nov. 20, 1992 for Electrode Cap for Acid Mist Suppression, now abandoned.

This invention relates to an electrode cap having an integral tank cover for acid mist collection. The acid mist collection to which this invention is applicable is utilized with electrochemical recovery or refining of metals, for example electrowinning of acidified copper from copper sulfate bearing solutions. The example now described relates to electrowinning of copper, although the concept can also apply to other metals and to electrorefining as well as electrowinning.

In this Continuation-in-Part Patent Application, we set forth a method and apparatus for solution of the newly discovered problem relating to the formation of crystals of metal sulfate (e.g. copper sulfate in the case of copper electrowinning). Specifically, these sulfate crystals may form around and obstruct exhaust vents between the cover of this invention and the underlying surface of the bath. The solution when or if this problem is encountered includes allowing the recirculating electrolyte discharge drain to act as a gas discharge duct with one of the preferred embodiments including allowing gas entrainment in the outflow to provide the required air movement. It will be understood that while copper is the preferred embodiment, other processes of electrowinning or electrorefining are covered as well by the disclosed invention.

STATEMENT OF THE PROBLEM

Processes utilizing electrolysis for the plating of metals are well known. What occurs is that in an electrolyte bath, metal is plated out from solution onto a cathode, sometimes concurrent with dissolution from an anode. In the case of electrowinning of copper from copper sulfate contained in solution with sulfuric acid, an exceptionally pure form of copper is extracted.

Oxygen gas is liberated at the anode as a by-product of this electrolysis process. Unfortunately, this gas liberated during the process forms tiny bubbles which rise to the top of the plating bath. At the top of the plating bath, these bubbles burst. And when the bubbles—formed of thin layers of acid—burst, they emit to the surrounding atmosphere an acid aerosol. This acid aerosol can be a source of pollution from electrolysis including electrowinning and electroplating.

Once the acid is in a mist, it is difficult to remove from the contaminated air except by utilizing processes involving the input of energy. Such processes include the utilization of large ventilation systems, scrubbers, precipitators or the like.

It will also be understood that the electrolyte has a vapor pressure. This vapor pressure also contributes to the acid aerosol. This being the case, it will be understood that this disclosure is applicable to electrorefining. Likewise, this disclosure applies to permanent cathode technology and starter sheet technology. Variations can include other electrolytes other than sulfuric acid.

BACKGROUND OF THE INVENTION

Attempts have been made in the prior art to remove and inhibit the acid mist arising over the tops of such plating tanks. In order to understand this aspect of the problem, a brief description of the electrowinning process for the reduction of copper interior of an electrolytic tank will be set forth. In the description of the process, the need to maintain ready access to the electrodes of the tank will be understood. Thereafter, a summary of the attempted solutions of the prior art will be set forth—together with their known shortcomings.

Modern electrowinning occurs in corrosion resistant tanks—typically made of plastic or plastic fiber concrete mixtures. These tanks are relatively large; they can be about 6 meters long, 1.2 meters across, and 1.4 meters deep, containing in the order of 8 cubic meters of electrolyte containing copper sulfate dissolved in a sulfuric acid solution.

Each tank is provided with an array of depending typically flat electrodes. The electrodes are alternating planar cathode and anode electrodes suspended from the top of the tank and depending downward into the depth of the tank to a depth less than the total depth of the tank. The anodes are provided somewhere along their length with anode insulators; these insulators prevent direct anode to cathode shorting and maintain minimum anode/cathode spacing sufficient for the desired plating. Typically the cathodes, onto which the metal is plated, are larger than the anodes and provided with edge strips. These edge strips cause plating to occur only on the sides of the cathodes so that the copper when plated can conveniently be removed from the flat planar cathode surface. Provision is made for the inflow of fresh electrolyte at one tank end and the outflow of depleted electrolyte at the opposite tank end.

Naturally, the electrodes are communicated with sufficient electrical current to cause the electroplating to occur. Consequently, bus connections to each tank combine to form electrical connections to each electrode resulting in the current between the electrodes to produce the required plating.

In the typical electrowinning process, the anodes are in large measure left in place. The cathodes must be periodically removed for the harvesting of the plated copper. Typically, the tanks are maintained as a group under a common roof in an otherwise large building referred to in the industry as a tank house. This imposes two practical requirements upon the tanks.

First, ready overhead access for the removal and insertion of the cathodes must be available. Second, the electrical connections—which are in a naturally corrosive environment—must be maintained in a relatively conductive state.

Having described the electrowinning environment this far, and remembering that the primary problem is the prevention of the escape of the acid mist, caused by the oxygen gas escaping during the plating process, the prior art attempts to alleviate this problem can now be set forth.

It has been realized in the industry that conventional covering of such tanks is not satisfactory. First, such covering interferes with the required ready access for the cells; removing and replacing a cover before cathode removal or other tank service is not desirable. Secondly, the covering of the electrical connections to the anodes and cathodes is not desirable. Corrosion and depositions under covers destroys conductivity and builds resistance. Finally, acid mist coalesces on the covers in a concentrated format. It then drips down onto the covered electrode supporting parts and connections of the tank, causing corrosion and shorting. As a consequence, for at least these reasons, such covers are not used.

The most commonly used expedient is voluminous ventilation. Massive amounts of air are circulated through such tank houses in the hopes that the acid mist can be swept away before its corrosive effect can harm the health of workers or the interior of the building and its contents. Unfortunately, this is not satisfactory. Worker health may be impaired. Further, the interior of such buildings is an environment in which corrosion rapidly occurs. Attempting to solve this kind of pollution with atmospheric dilution is not satisfactory.

Layers of plastic balls or other acid-inert particles have also been attempted. The theory behind these floating layers is to form a circuitous path for the aerosol from the bursting bubbles—and thereby to attenuate the emission of mist to the environment. This does result in some mist reduction. The emitted aerosol to a limited extent condenses out on the floating objects and finds it way back to the bath. Unfortunately, acid mist or aerosol is still emitted in significant quantities. Therefore, while this expedient is commonly utilized, it does not constitute a complete solution to the problem.

An additional attempt to mitigate this problem has involved utilizing surfactant in the upper layers of the sulfuric acid bath. The theory is that the reduced surface tension of the acid solution will retard the incidence of bubble formation. While this works only to a limited extent, it has a severe drawback.

It will be remembered that the electrolytic solution is circulated through the bath on a continuous basis. When the solution leaves the bath, it goes through a solvent extraction process which enriches the copper content of the solution so that it can be returned to the tank for further electrolysis. This solvent extraction process is a precise, two phase chemical process in which contaminating surfactant should be avoided. Simply stated, no matter how elaborate the precautions taken, sooner or later surfactants find their way into the solvent extraction process—and the process must be halted. Solution must be replaced, and production is lost. Given that the placement of surfactants only results in a partial abatement of the problem, surfactant because of their interference with the solvent extraction side of the process are seldom used.

Other attempts at solution of this problem have likewise been made. In Smith et al. U.S. Pat. No. 4,668,353 issued May 26, 1987 entitled METHOD AND APPARATUS FOR ACID MIST REDUCTION, coalescing of aerosol is taught by providing surface limiting electrically inert masking device in which one portion is submerged in the electrolyte. The idea behind the device is to locally coalesce the mist and redeposit the coalesced acid back into the bath. Emission of aerosol still results.

In an alternate solution, partial "roofing" of the bath was attempted utilizing spanning eaves attached to the anode spanning to the cathode. Two effects occurred. First, the aerosol mist still escaped. Secondly, and during the reinsertion of the cathodes, sulfuric acid dripped from the underside of the eaves onto the harvested and freshly cleaned stainless steel cathodes. These cathodes, representing a significant investment of the total electrowinning process, were etched—especially where they extended above the bath. This being the case, this attempt was abandoned.

In short, a solution has not thus far been found for the vexing problem of the aerosol or mist of acid in electrowinning or electroplating processes.

SUMMARY OF THE ORIGINAL INVENTION

In a tank confined electrowinning process having circulated electroplating solution containing sulfuric acid, a multi-element cover system is applied below the electrode connections and above the surface of the electrolyte bath. This cover is evacuated in the interstices below the cover and above the bath at a rate exceeding the stoichiometric ratio, mist generation, and evaporation rate causing any leakage to occur into the volume overlying the bath thereby preventing acid aerosol from escape.

The primary cover element constitutes a semi-rigid non-conductive material such as dual hardness extruded polyvinyl chloride. This is formed into tapered anode caps which are cross bolted through and fastened to opposite sides of the anodes by corrosion resistant fasteners. These anode caps each include an eave member spanning to the cathodes. These respective eaves are tapered and extend from a rigid portion of the extrusion fastened at the anode with sufficient span to form a substantially air tight seal with the cathodes immediately after the cathodes are freshly harvested and cleaned. The eaves on the underside preferably are sloped to and toward the anode. These eaves are sufficiently flexible to maintain a conformable seal at the inserted cathodes as well as to yield to allow the copper plated cathodes and their required edge strips to be both withdrawn and inserted. On the underside of the anode caps adjacent the ends of the eaves are so-called "drip lips" which protrude downward to and toward the bath. When the cathodes are inserted, the eaves flex downward toward the cathode. These drip lips then cause the sulfuric acid coalesced on the underside of the eaves of the anode caps to fall into the bath before reaching the cathode to avoid etching of the stainless steel of the freshly cleaned cathodes. At the respective tank sides normal to the plane of the anodes, a system of shingle-like overlapping flexible plastic strips form a substantially airtight seal to the tank sides and yet permit necessary insertion and withdrawal of the anodes. At the respective tank ends, covers are provided at both the electrolyte inlets and outlets. A ventilation exhaust system is communicated under the cover, preferably at the tank ends. This required ventilation system evacuates the underside of the resulting cover at a rate exceeding the stoichiometric ratio (preferably by a margin of 10 times) to acid mist and aerosol extraction apparatus which preferably constitute scrubbers. Thus, inevitable leakage of the resultant multi-component cover below the electrodes and above the acid bath occurs from the exterior of the cover into the ventilation evacuated interstices between the cover and bath. There results a cover system for the complete attenuation of acid mist in conventional electrowinning tank house installations, either on a retro-fit or new installation application.

STATEMENT OF PROBLEMS ENCOUNTERED WITH ORIGINAL INVENTION

After the filing of the Parent Patent Application herein (Ser. No. 07/978,945), difficulty was encountered in an electrowinning application in the removal of crystals of copper sulfate formed at or near the vent duct intakes and other areas of turbulence inside the duct for evacuating the gas. Before going further, Applicants wish to note that the discovery of a problem can constitute invention. In so far as we have been able to determine, the problem encountered as a result of our experimentation is novel, and is directly the result of the experimentation with the parent invention herein.

This invention was applied on an experimental basis in the United States in an individual cell in a tank house. The configuration of the cover was substantially the same as that shown in the original patent application. Venting the interstitial volume between the underside of the cover and above the surface of the bath proved difficult.

Specifically, and at the entrance to and inside the vent system from the interstitial volume, crystals of copper sulfate quickly formed. These crystals formed at such a rate that a four inch duct was closed in less than one hour by the concretion of crystals over the otherwise unrestricted vent duct when the cell was evacuated at approximately 100 times the stoichiometric rate (that is 10 times the previously preferred evacuation rate). At lesser evacuation rates, the crystal growth was still observed—although it occurred at slower rates. This high evacuation rate testing served to high-light potential severity of this crystal concretion problem.

The reader will understand that this problem encountered with copper, is likewise expected to be encountered with other metal electrowinning or electroplating. Specifically in zinc and nickel electrowinning and electroplating, this problem may well be encountered.

Investigation of the cause of the crystal formation was undertaken. The main cause for the crystal formation was the evaporation of water from the aerosol droplets causing the droplets to become super-saturated and thus to deposit as the copper sulfate crystals. This evaporation caused the crystals to form for at least four reasons.

First, the loss of water from the aerosol mist droplets raised the concentration of acid in the droplets. This urges the contained copper sulfate towards super-saturation.

Secondly, the loss of water also increased the concentration of the copper sulfate in the aerosol mist droplets. This second phenomenon also tended to accelerate super-saturation.

Thirdly, the evaporation cooled the aerosol droplets. This cooling of the droplets was a further factor in inducing super-saturation.

Finally, the aerosol droplets—mechanically injected into the interstitial volume—below the cover and above the surface of the bath, are particularly venerable to evaporation. The aerosol droplets have a high surface area per unit volume exposure to surrounding gases.

The observed reaction was chain like in nature. As the vent ducts became more constricted, faster deposition of crystal particles occurred. Further, the super-saturated solution upon encountering crystals, rapidly produced more crystals. Accordingly, and to solve this problem, the following solution was generated.

SUMMARY OF THE INVENTION

In a tank confined electrolysis process, such as electrowinning or electrorefining, having circulated electroplating solution containing sulfuric acid, a multi-element cover system is applied below the electrode connections and above the surface of the electrolyte bath. Venting of the interstitial area is at a rate which is at least slightly in excess of the combined rate of the stoichiometric ratio for the oxygen generation with attendant acid mist entrainment plus the incidental evaporation from the electrolyte. This causes slight leakage from the outside of the cover, to the inside volume, preventing the escape of acid aerosol mist. The interstitial volume below the cover and above the surface of the bath is evacuated preferably through a wetted weir, such as a circular discharge weir used to discharge electrolyte solution during recirculation of the fluid in the electrolysis tank. In a preferred embodiment, it has been found that the flow of liquid down a circular drain entrains sufficient gas that the forced evacuation of gas is not required; forced evacuation in the drain system may as well be used. Further, since all surfaces around the drain are covered with outflowing electrolysis solution, crystal formation as a practical matter cannot occur. There results the desired absence of acid aerosol mist above the tank cover with discharge of the acid mist aerosol from the interstitial volume without the accumulation of copper sulfate crystals and other crystals around the vent under the cover.

Crystal deposition occurred at evacuation rates of around 100 times the stoichiometric rate. We define the stoichiometric rate to exclude evaporation. For normal conditions, this ten times the stoichiometric rate is equivalent to two times the stoichiometric rate plus the rate of evaporation.

The reader will understand that the rate of evaporation varies and is not a unique rate. However, the ten times the stoichiometric ratio provides a workable approximation for our process.

In short, we have found that crystal concretion can be a problem and where that problem is encountered, evacuation of under cover atmosphere through a wetted weir provides a solution to the crystal concretion problem.

DESCRIPTION OF THE ORIGINAL PREFERRED EMBODIMENT

Figure 7:
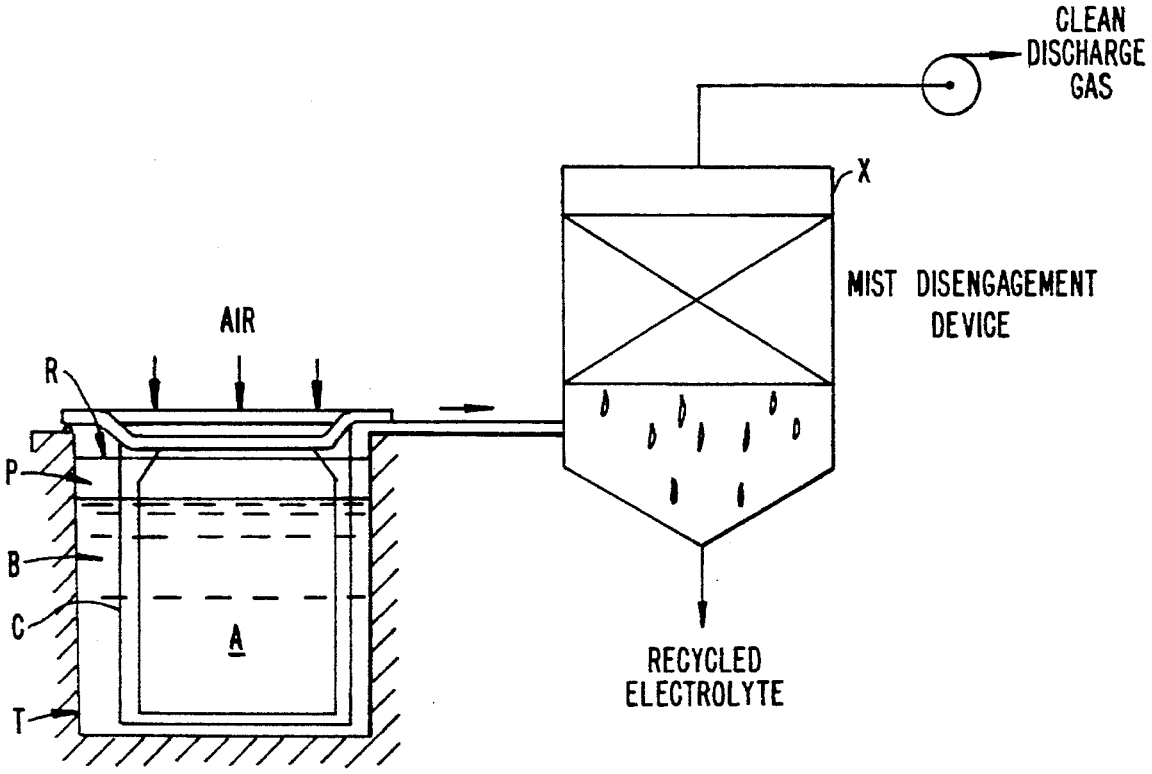
FIG. 7 is a system and process schematic illustrating how the multi-component roof system of this invention is connected to evacuating ventilation and a mist disengagement device (here shown as a scrubber) so as to effectively confine acid mist pollution to a contained path between the interstices of the tank cover and the illustrated scrubber.

Referring to FIG. 7, electrowinning tank T having a series of electrodes including anodes A and cathodes C are placed within a bath of copper bearing sulfuric acid aqueous solution. Direct current is conventionally supplied by apparatus not shown producing plated metal (here copper) on cathodes C and producing an acid mist.

A multi-component roof system R is placed over the acid bath B. This roof system is below the supports and electrode electrical connections of the anodes A and cathodes C but above the surface of bath B. Thus, between the underside of the multi-component roof R and bath B there is defined a plenum P.

Plenum P is evacuated by ventilation to mist disengagement device X, here shown as a scrubber. Such evacuation occurs at a rate exceeding the so-called stoichiometric ratio of oxygen gas by-product produced relative to the plating occurring together with the evaporation rate and the mist generation. By way of example, it is known that for each 63 pounds of copper plated, stoichiometrically about 180 cubic feet of oxygen gas are produced. By exceeding this rate of ventilation exhaust, all gas and acid mist will be withdrawn.

It should be noted that in order to permit this rate of evacuation, the multi-component roof R must admit air from the atmosphere. Air enters from above roof R into plenum P.

Having schematically set forth this invention, the detail may now be understood referring to the remaining Figures.

Figure 1A:
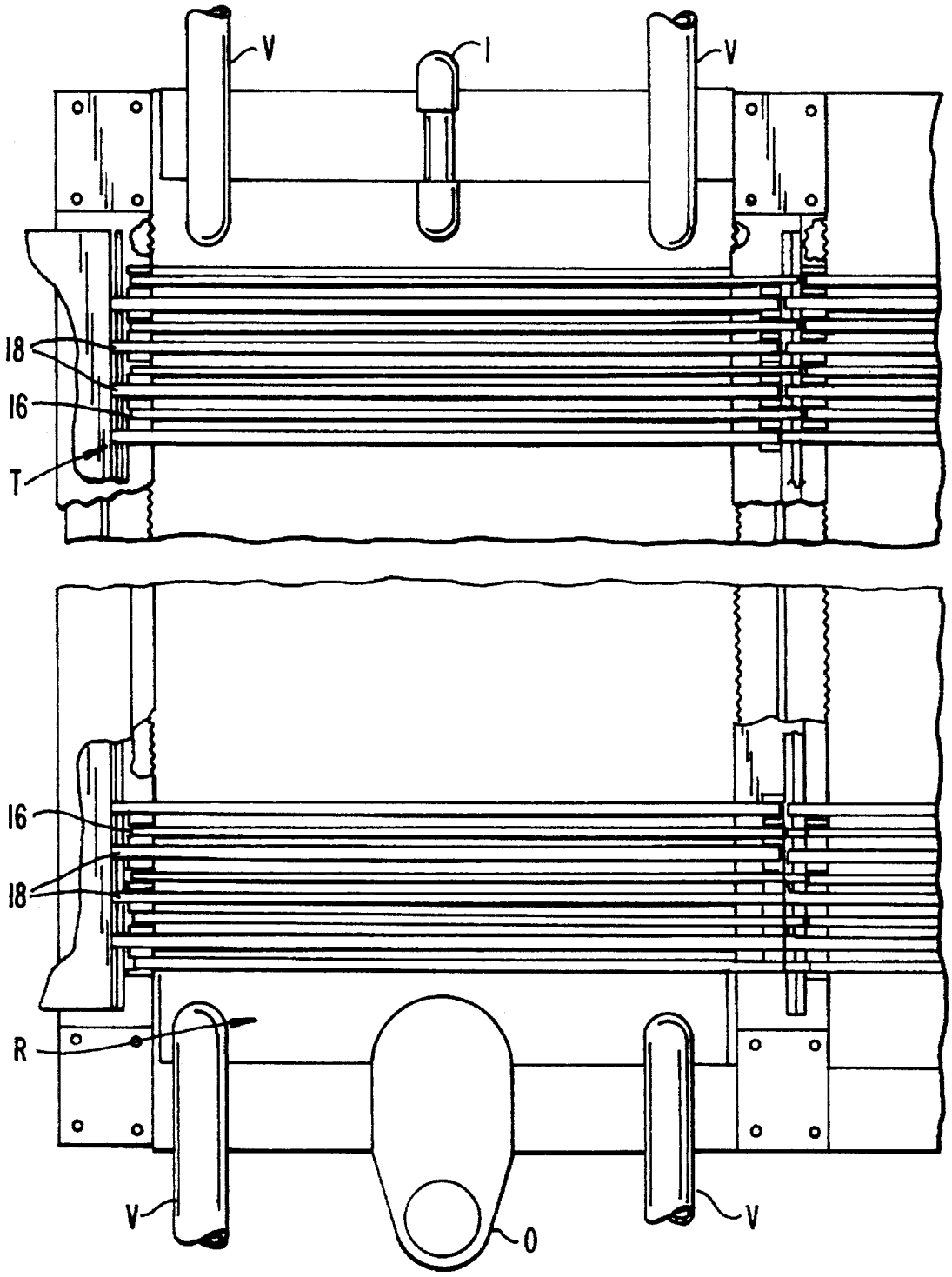
FIG. 1A is a top plan view of an electrowinning tank for the reduction of copper by electrolysis broken away in the medial portion of the tank illustrating the multi-element cover and connected ventilation.
Figure 1B:
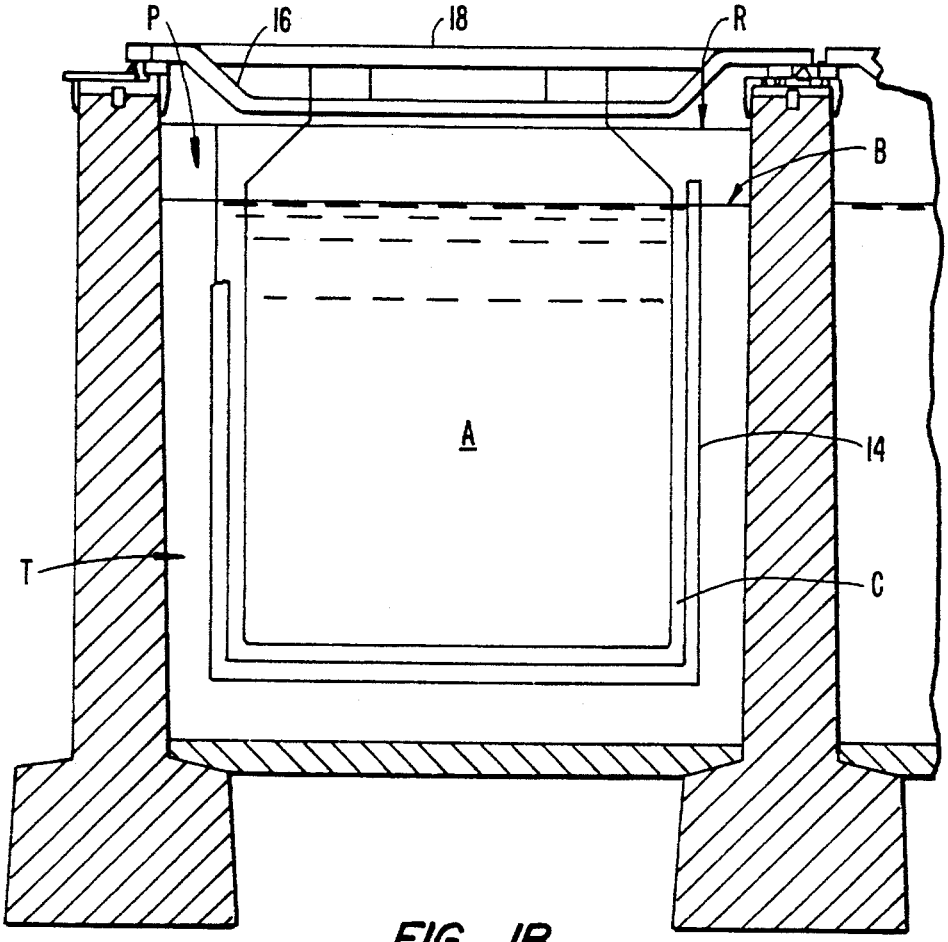
FIG. 1B is a side elevation section taken to expose an anode illustrating the support and electrical connection of the electrodes above the bath surface with the multi-element cover of this invention disposed between the electrical connections and the bath surface.

Referring to FIGS. 1A and 1B, tank T is illustrated having a sulfuric acid bath B and depending supported cathodes C and anodes A. Electrical connection to the respective anodes A and cathodes C are made through their respective supports 16, 18, and are conventional and therefore not shown.

Cathodes C include an edge strip 14 which confines copper plating to the faces of the stainless steel cathodes C; thus the plated cathode can be readily removed, cleaned and prepared, and thereafter returned.

Tank T has a constant flow of solution passing therethrough. This being the case, solution is input at inlet I and output at outlet O.

The multi-element roof R formed by this invention defines below the electrical connections to the electrodes and above the surface of bath B a plenum P (See FIG. 1B). In the preferred embodiment, this plenum P is evacuated by vents V to mist extractor or scrubber X (not shown in FIG. 1A). Since this evacuation occurs at a rate exceeding the production of oxygen gas by the plating process (the so-called stoichiometric rate), the multi-element roof R leaks from above roof R into plenum P.

The construction of the multi-element roof R can be described in detail. First, and with respect to FIGS. 2 and 3, the electrode caps will be described. Secondly, and with respect to FIGS. 4A and 4B, the connection of the multi-element roof R to the side of tank T will be described. Finally, and with respect to FIGS. 5A–5C and 6A–6B, the end tank construction will be set forth.

Figure 2:
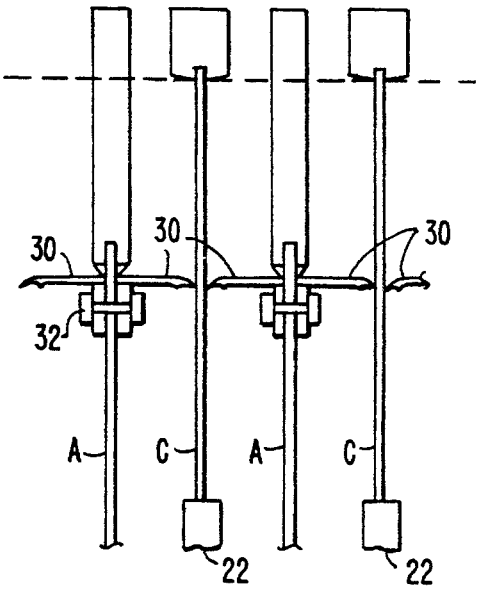
FIG. 2 is a side elevation taken at the electrode cover elements of this invention, the cover elements here being shown fastened to both sides of an anode and bridging out into conforming substantial air tight contact with adjacent cathodes.

Referring to FIG. 2, the main working elements of the multi-component roof R extending between cathodes C and anodes A can be seen and understood. Anodes A are here shown with caps 30 extending to and forming a substantial air tight seal against cathodes C. The two cathodes there illustrated are shown with plated copper 22 at the bottom portion of the drawing shown in FIG. 2. Fastening of caps 30 is here effected by fasteners 32, which fasteners can be corrosion resistant bolt and nut fasteners.

It goes without saying that tank T, multi-element roof R, caps 30, and fasteners 32 are all constructed of non-corrosive materials. Polyvinyl chloride is suitable for roof R, caps 30, and fasteners 32. Likewise, fastening—as for example by clipping and the like—can occur.

The particular cap 30 here illustrated is designed to fit to the anode A. The reader will understand that variations of this design can include fitting the cap to cathode C or to both cathode and anode. What is important is that the electrode caps 30 utilized be capable of retro-fit and permit the substantially unobstructed removal and insertion of all of the electrodes—both anodes A and cathodes C—as necessary for carrying out the electrowinning process.

Figure 3:
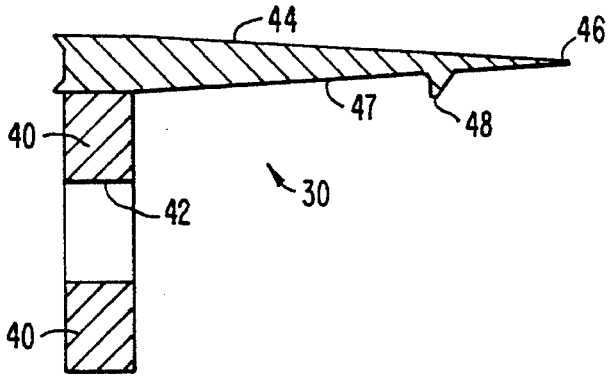
FIG. 3 is a side elevation section of the electrode cap of this invention with a dual hardness extrusion including a substantially rigid member for fastening to the electrode and a tapered flexible member for extending to an adjacent electrode, the construction here being of a cap for preferable attachment to an anode with a downward protruding lip for preventing dripping of acid to an adjacent cathode.

Turning to FIG. 3, an electrode cap 30 is illustrated. This is a polyvinyl chloride extrusion including a lower rigid member 40 having spaced apart bores 42 that enable mounting by bolt and nut fasteners 32 to corresponding spaced apart bores on anode A. An upper flexible and tapered member 44 spans outwardly from cap 30 to tapered end 46. This tapered member 44 has undersurface 47 normally sloped away from cathode C toward supporting anode A.

Underside 47 of cap 30 includes a continuous ridge 48. The purpose of ridge 48 is to divert liquid acid coalescing from acid mist within plenum P from passing along undersurface 47 and onto a cathode C passing adjacent tapered end 46. This function can be more clearly understood once the dimension and flexibility function of flexible member 44 is understood.

Regarding the dimension of flexible member 44, it is always of a length to permit a substantially air tight seal with an adjacent cathode C. This requirement effectively defines the span of the member.

Regarding the flexibility of flexible member 44, it must be flexible enough to allow plated cathode C with copper 22 to be withdrawn. Further, sufficient flexibility must be provided to allow required cathode edge strips 14 (See FIG. 1B) and any electrode spacers utilized between anode A and cathode C to pass.

It will be understood that when an adjacent electrode—here a cathode—is inserted, bending downward of undersurface 47 will occur. It is at this time ridge 48 dislodges coalesced acid.

It will be understood that ridge 48 and end 46 will admit of variation. Any slope or structure which can prevent dripping of the coalesced acid onto the adjacent or attached electrode is intended to be covered.

At the same time, it will be understood that the roof components including cap 30 are not air tight. It is actually preferred to have a constant and substantial air leakage from atmosphere to plenum P to insure isolation of the acid aerosol.

Figure 4A:
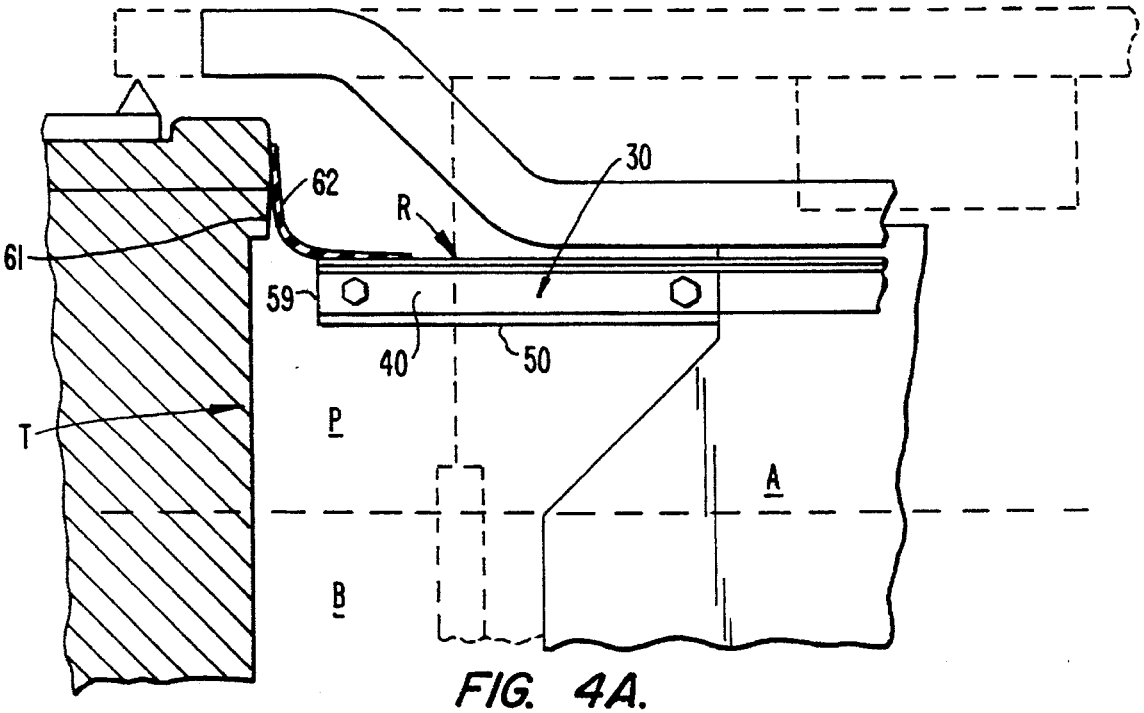
FIGS. 4A and 4B are respective side elevation and plan views of side-by-side anode caps illustrating overlapping flexible planar members at the side edges of the cap which are shown in the view of FIG. 4A providing a substantially air tight seal at the tank sides.

Referring to FIG. 4A, it will be seen that the anode caps 30 are completed by a spacer 50 that extends between rigid members 40. Spacer 50 occupies the interval between the depending anode A and the sides of tank T. Thus, anode caps 30 will be understood to form in conjunction with the top of the anodes A and the top of the cathodes C, a continuous multi-element roof defining plenum P between the top of bath B and the underside of roof R.

With respect to the complete multi-element cover extending over tank T, this leave two areas unaccounted for. Those areas are the tank T sides and the tank T ends. It is to be understood that the coverage of these areas is required.

Figure 4B:
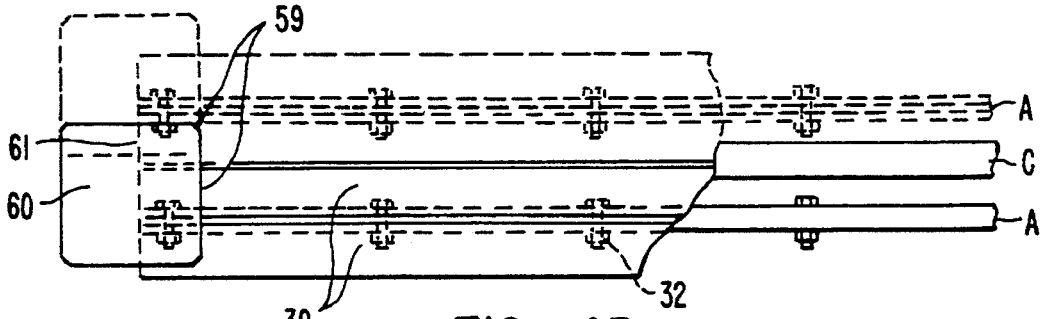

Referring to FIGS. 4A and 4B, the covering to the tank T sides is easily understood. Referring to FIG. 4B, it will be seen that semirigid inert and flexible pads 60 are fastened to the respective ends 59 of electrode caps 30. These flexible pads have two important dimensions.

First, the dimension of pads 60 axially of the tank T is selected so that the pads 60 overlie one another like shingles on a roof. Unlike shingles on a roof, the particular order of overlap is not important, as the particular multi-element roof here shown "leaks" from the outside to the inside.

Secondly, the dimension of the pads 60 in a dimension measure across tank T is such that the pads cantilever into contact at the sides 61 of tank T. Thus, when anode A are lowered into tank T, and upward overlap 62 such as that shown in FIG. 4A occurs. Thus it will be understood that the multi-element roof is substantially complete with respect to the tank sides.

Figure 5A:
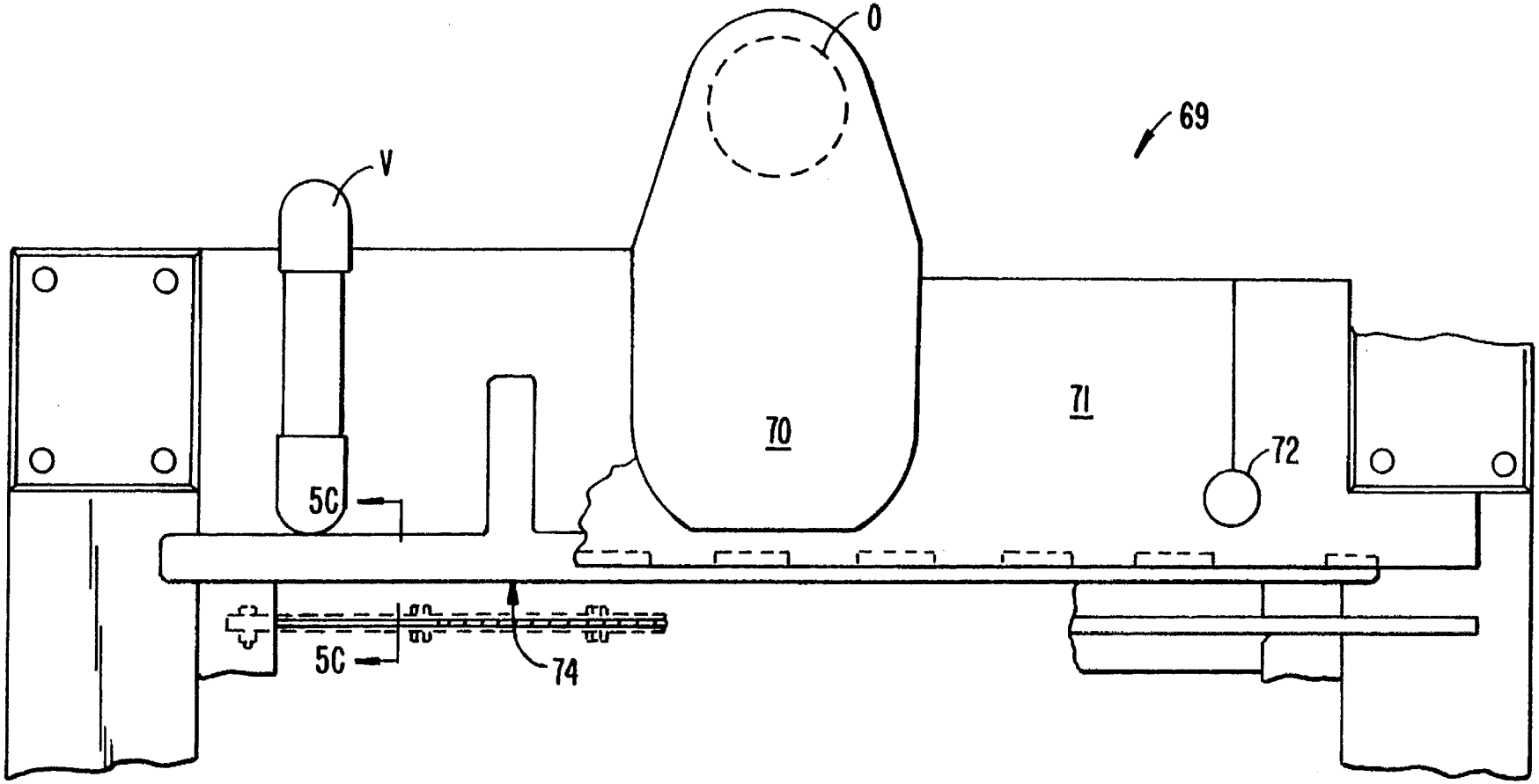
FIGS. 5A and 5B are respective plan views and side elevations of the tank end cover illustrating the caps defining a plenum for the withdrawal of air with acid mist.
Figure 5B:
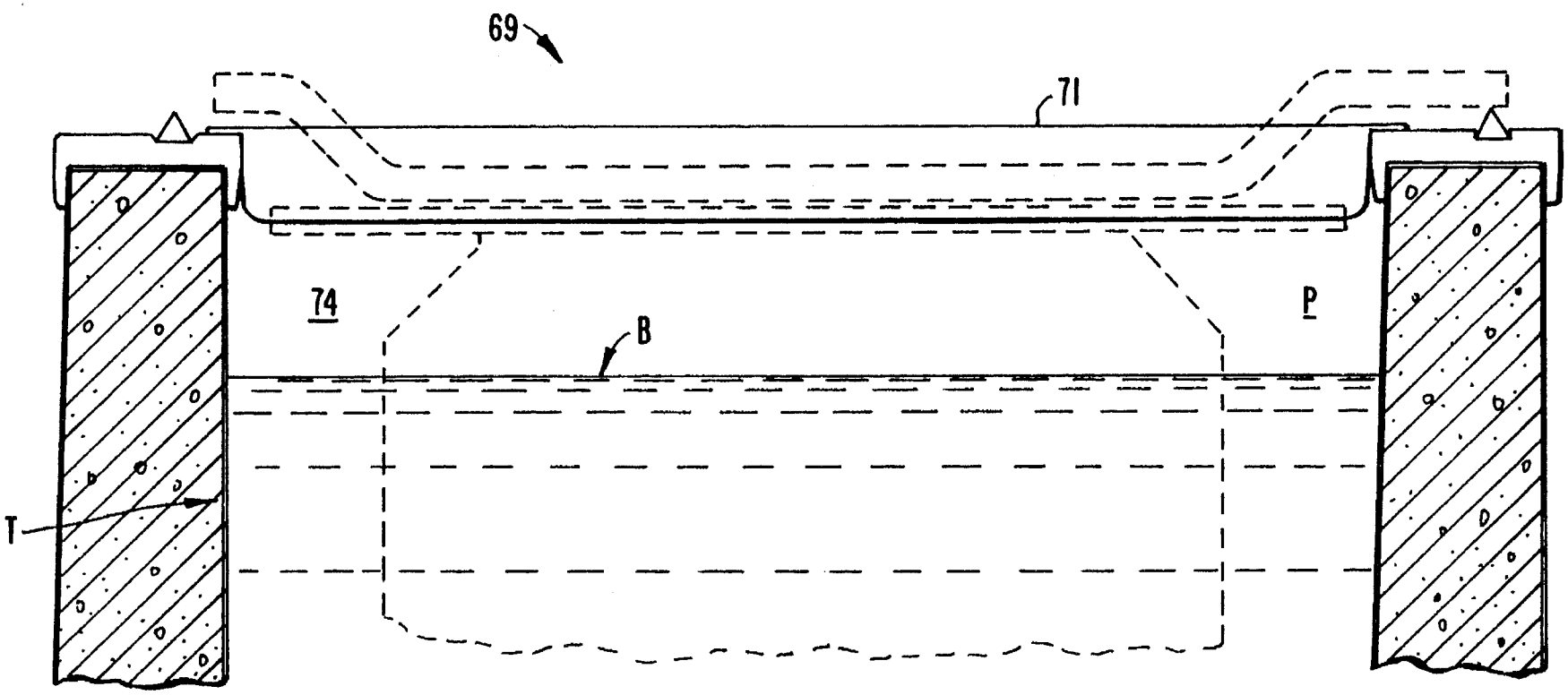

Referring to FIG. 5A and 5B, tank roof end member 69 can be understood. An outlet cover 70—which is conventional is shown. A cover 71 spans the tank T end and includes an end dam 74. Holes 72 provide for connection of exhaust vents V, providing the preferred plenum P discharge for this invention. Suitable overlap and fitting to tank T sides and ends is provided by conventional overlaps along cover 70.

Figure 5C:
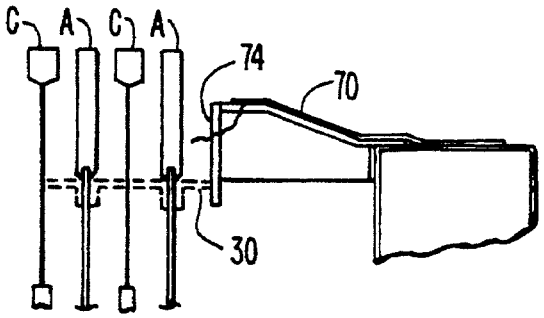
FIG. 5C is a detail at the end of the tank illustrating the last anode end cap in contact with the seal at the end of the tank.

Referring to FIG. 5C, it will be seen that end dam 74 depends downward below bath B. End tank anodes A span outward and contact end dam 74 much in the manner that they would contact an adjacent cathode C.

Figure 6B:
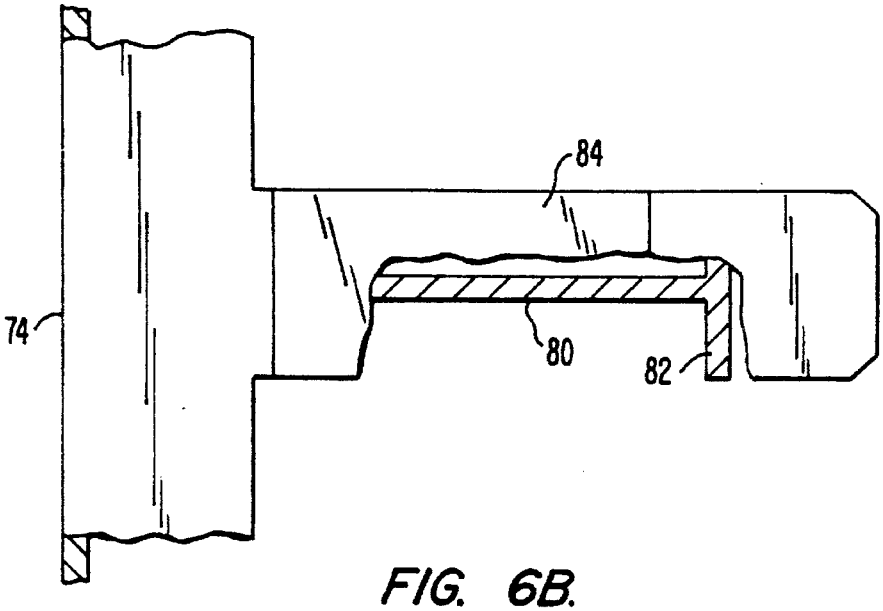
FIGS. 6A and 6B are details of the end tank cap construction taken with respect to FIG. 5A.
Figure 6A:
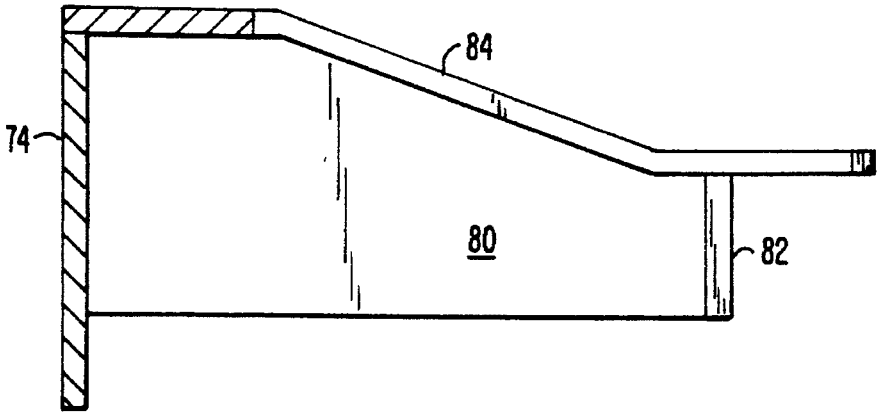

Referring to FIGS. 6A and 6B, it will be understood that end dams 74 are provided with spanning axial gussets 80, cross gussets 82 and an overhead seal strip 84. Strip 84 fits against cover 71 in overlap to substantially seal tank roof end member 69.

It will be understood that the construction of this invention may vary from the preferred detail set forth herein. Specifically, electrode caps can be attached to the cathode. Likewise, the construction of the multi-element roof R can vary widely at tank T sides and ends to accommodate various tank and electrode arrays.

It will be understood that the support of the cover can vary. We prefer the cover to be supported from the electrodes—in electrowinning preferably the anode. In electrorefining, support from the cathodes may be desired. Further, support does not have to be confined to the electrodes—in some applications support of the covers from the tank sides may work as well.

DESCRIPTION OF THE NEW PREFERRED EMBODIMENT

In the following description, we will first discuss the rate of evacuation of gas from under the cover and over the surface of the bath. This rate will be set forth only to slightly exceed the combination of the stoichiometric ratio for oxygen generation with attendant acid mist entrainment plus the incidental evaporation for the electrolyte under the cover and above the surface of the bath in the electrowinning tank. The purpose is to produce sufficient leakage from the atmosphere above the cover through the cover into the interstitial volume below the cover and above the surface of the tank to prevent the escape of aerosol acid mist. At the same time, the rate of evacuation is held sufficiently low to maintain high humidity to retard evaporation to the maximum extent possible.

Secondly, we will set forth with reference to FIG. 8 and 9, the construction of the circular drain for discharge of both electrowinning solution and exhaust of the acid mist aerosol containing gases in the interstitial volume under the cover and over the surface of the bath. After passing through the low velocity opening in the weir, the exhaust air and mist pass through the cell drain pipe. It will be seen that the disclosed wetted surface about the drain provides an exhaust exit where the deposition of copper sulfate crystals is not possible. It will be understood that similar discharge weirs can be utilized wherever a crystal deposition problem is encountered.

Thirdly, emphasis will be placed on the drain construction as providing sufficient entrainment and/or eduction of gas to enable evacuation of gas from the interstitial volume under the cover and over the surface of the solution in the tank. It will be disclosed that a sufficient destination for the gas is provided in the common discharge manifold serving the collective tanks of a tank house, that this air entrainment is sufficient for the required evacuation.

It may be that liquid falling into the drain will not provide sufficient entrainment. In this case other sources of suction may be used, including eduction. Such air will naturally be cleaned by known devices—such as scrubbers to produce cleaned gases discharged to atmosphere.

Rate of Evacuation

First, general comment may be made about the particular tanks T utilized. Typically, they are about 5 to 25 meter$^3$ of capacity. Flow rates of electrolyte through the tank are in the range of 200 liters per minute. Freshly introduced copper sulfate solution contains about 35 grams per liter of copper. Depletion of copper at the outflow is only 2 to 3 grams per liter.

In our original work, we opined that an evacuation rate in the amount of 10 time the stoichiometric ratio would assure the required venting of the interstitial volume below the cover and above the surface of the completely "covered bath." It was in testing flows greater than this preferred rate that we discovered the copper sulfate deposition problem on dry surfaces. Subsequent analysis has established the following.

Where an atmosphere of relatively low humidity is provided, evaporation of water from the aerosol occurs essentially within milliseconds. This rapid evaporation includes at least four effects—all these effects tending to super-saturate the aerosol acid mist.

First, the amount of water in each aerosol droplet is reduced. This raises the concentration of the acid, tending to super-saturate the sulfate solution.

Secondly, as the amount of water is reduced, the dissolved copper sulfate as a fraction of the total droplet increases. This is another factor tending to produce super-saturation.

Thirdly, evaporation reduces the temperature of the aerosol droplets. This reduction in temperature further induces supersaturation.

Finally, it will be understood that the aerosol droplets as mechanically injected into the interstitial volume of gas below the cover and above the surface of the bath are particularly venerable to evaporation. By their very nature, they contain the high surface area per unit volume exposure to surrounding gases.

In short, we have discovered that the humidity in the interstitial volume should be maintained as high as possible to retard evaporation of water from the acid mist aerosol. Higher velocity air flows encourage impingement of the aerosols on any obstruction or area of turbulence. These conditions are avoided by maintaining the evacuation rate sufficient so that leakage just begins to occur from the atmosphere overlying the tank, through the cover, and into the interstitial volume.

As a rate of evacuation, we contemplate evacuation at a rate which does not greatly exceed the sum of the stoichiometric rate of gas generation, mist entrainment, and rate of evaporation from the electrolyte.

We define the stoichiometric rate to exclude evaporation. For normal conditions, ten times the stoichiometric rate is equivalent to two times the stoichiometric rate plus the rate of evaporation.

The reader will understand that the rate of evaporation varies and is not a unique rate. However, the ten times the stoichiometric ratio provides a workable approximation for our process in the normal tank house environment.

In short, we have found that crystal concretion can be a problem and where that problem is encountered, evacuation of under cover atmosphere through a wetted weir provides a solution to the crystal concretion problem.

We also note that the problem of crystal deposition is more aggravated in the case of electrowinning—where copper is plated out entirely from acidified copper sulfate solution—than in the case of electrorefining. In electrorefining, essentially pure acid solution is utilized between electrodes to transfer copper ions from a relatively impure copper anode to a high purity copper cathode. In these cases, there is less oxygen and acid mist generation. Consequently, the deposition of crystals is not believed to be as aggravated a problem in these environments. It will be understood that in order to control copper concentrations in the acid electrolyte solution in electrorefining, certain "liberator cells" are utilized. Simply stated, the electrorefining operation causes any copper oxide in the impure copper anode to be dissolved by the acidified electrolyte and to increase the concentration of copper sulfate in solution. Hence, a small and continuous stream is diverted to the liberator cells where electrowinning occurs. This electrowinning causes copper sulfate to be removed from the acidic electrolyte solution used in electrorefining. In such cells, the crystal deposition problem may possibly occur to an extent similar to the deposition encountered in the standard electrorefining cells. The electrorefining and electrowinning application of this disclosure will apply to metals other than copper. For example, zinc and nickel processing are intended to be covered as well.

Experiments have been conducted on a single cell in an electrowinning operation. Specifically, as against current regulation requiring no more than one milligram of sulfuric acid per meter$^3$ of air, levels of about 0.1 milligram per meter$^3$ have been obtained. In all cases, results have been below that required by regulation.

Having set forth the rate of evacuation, attention can now be directed to the construction of the circular weir.

Construction of the Weir

Figure 8:
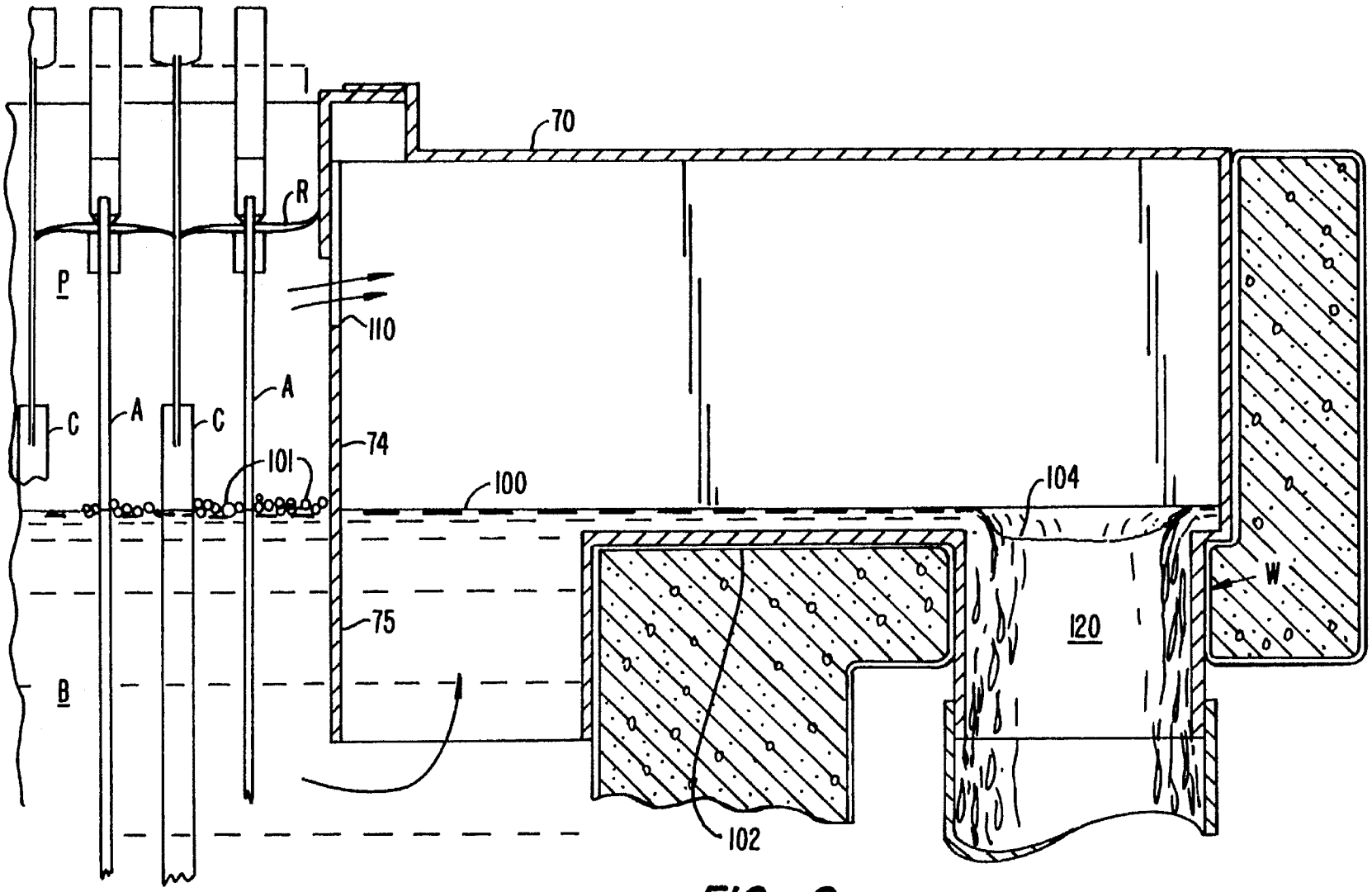
FIG. 8 is a section taken across the tank in the vicinity of the drain for sulfuric acid copper sulfate solution outflow illustrating the construction of the tank cover end for permitting the circulation of gas from the interstitial volume below the cover and above the surface of the bath.

Referring to FIG. 8, an enlarged cross-section in the vicinity of a discharge circular weir is illustrated. Before discussing the specifics of weir construction, several points need be made:

First, as in the prior embodiment, tank T is completely covered by multi-component roof system R. Acid bath B plates copper on cathodes C, which cathodes are periodically harvested.

Second, multi-component roof system R covers the bath, from inlet to outlet and to sides 61 of tank T. Thus, escape of gas from plenum P is not possible at either end of the tank without passage through multi-element roof R.

Outlet cover 70' is modified in an important aspects over the embodiment illustrated in FIG. 5C. As before, end dam 74 penetrates below surface 100 of acid bath B. Acid bath B is here shown having beads 101 covering surface 100 in a conventional method of acid mist suppression.

To exit tank T acid must pass under the barrier 75 protruding below the surface of acid bath B from end dam 74. This barrier 75 prevents material floating on the surface of bath B from passing to circular weir W (this material can include floating balls or beads to inhibit aerosol liberation). Thereafter, acid flows over outflow dam 102 and into the vicinity of circular weir W.

Circular weir W is easily understood. It defines a rim 104 slightly below surface 100 of acid bath B. Outflowing acid falls initially in a sheet providing a substantially constant wetting to rim 104. Rim 104 is about 6 inches in diameter. In some cases, a screen may be placed over the opening to the weir W. It is not shown here because the action of the weir W remains essentially unchanged with or without such a screen.

End dam 74 above barrier 75 includes vent opening 110. Vent opening provides a path from plenum P to circular weir W for gases confined in the interstices between the bottom of multi-component roof system R and surface 100 of acid bath B.

For purposes of this discussion, it will be assumed that the central portion 120 of circular weir W is communicated to an exhaust for the gases containing the aerosol droplets. It will therefore be seen that gases are drawn from plenum P, through vent opening 110 and into central portion 120 of circular weir W.

At this juncture it can be observed that circular weir W literally provides no location for the deposition of copper sulfate crystals. Since rim 104 is constantly wetted, any crystals having the tendency to deposit, will be simply wash away. Thus it will be understood that this disclosure contemplates a gas discharge centrally of a weir with the weir having a rim washed by out flowing fluid having less than a super-saturated solution of the substance from which the crystals are formed. This arrangement for the venting of acid mist droplets having solutions which can become supersaturated and deposit crystals can be used not only at outflows to tanks T but anywhere the two phase combination of out flowing liquor and aerosol droplets are found.

It will be apparent that weir W can have alternate construction. For example, weir W can be square. Further, flow of the weir can be constructed to be over a single edge or through an orifice. What is important is that a substantial section of the weir include a constantly flowing stream that inhibits and prevents the formation of crystals.

Self Venting Feature of the Weir

It has been found that the gas entrainment provided by the outflow of acid bath B can be sufficient to produce the required draft from plenum P to an exhaust conduit 140. Such an arrangement is illustrated in FIG. 9.

Figure 9:
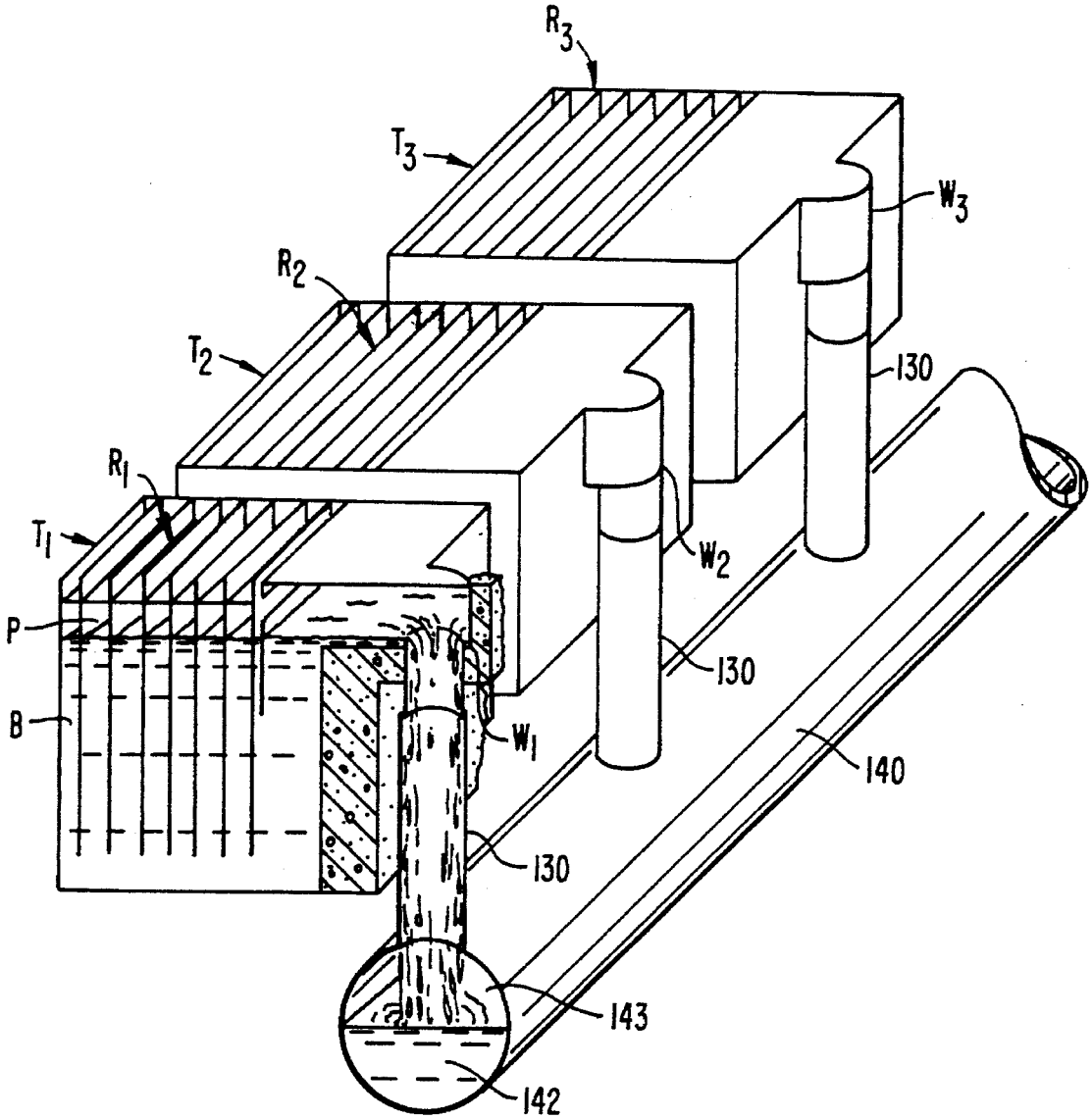
FIG. 9 is a schematic illustrating the outflow from the circular drain being collected to a common collection manifold for recirculating the discharged electrowinning solution, the schematic illustrating the air entrainment effect to the common collection manifold; and, FIG. 10 is a schematic of a recirculation system illustrating a common collection tank vented prior to the treatment of the fluid within the tank for restoring the concentration of copper for ultimate re-circulation of the electrowinning solution.

Referring to FIG. 9, tanks $T_1$–$T_3$ are illustrated having circular weirs $W_1$–$W_3$. Each weir $W_1$–$W_3$ outflows to a collection manifold 140 through downcomer 130. It has been found that without substantial modification, downcomers 130 can be designed to provide sufficient draft to cause sufficient outflow from under multi-component roof system R to prevent the escape of gas in plenum P (see FIG. 8). Flow into downcomer 130 discharges to collection manifold 140 which contains acid in lower portion 142 and gas in upper portion 143. Interestingly enough, the construction of collection manifold 140 is not unique to this disclosure; tank houses containing multiplicities of tanks T commonly have collection manifolds 140 of the illustrated construction.

As an incidental, circular weirs W also have the illustrated construction. Specifically, it is common for such weirs to have downcomers 130 with lengths of three to eight feet. It should be noted that circular weirs W, downcomers 130, and collection manifolds 140 are constructed so as to prevent a continuous film of acid—which otherwise would be a conductor—from communicating the considerable current between the cathodes C and anodes A to collection manifolds 140. It has been found that this very construction—designed to interrupt electrical current flow—also can provide sufficient entrainment and/or eduction to exhaust gas from plenum P of a single tank T.

The reader will understand that as of this writing, the illustrated circular weir W is preferred. It will be further understood that it may be expedient in the future to design weirs W having enhanced air entraining flows over their respective edges. We do not illustrate such weir here because they are yet to be engineered or detailed. We do note that such weirs W may well be desirable.

It will be further realized that the entrainment herein provided may in fact provide some "scrubbing" or acid aerosol removal of acid gas and mist. However, this removal is believed to be imperfect; it may well be that electrolyte flowing from the tank T can still be effervescing.

Figure 10:
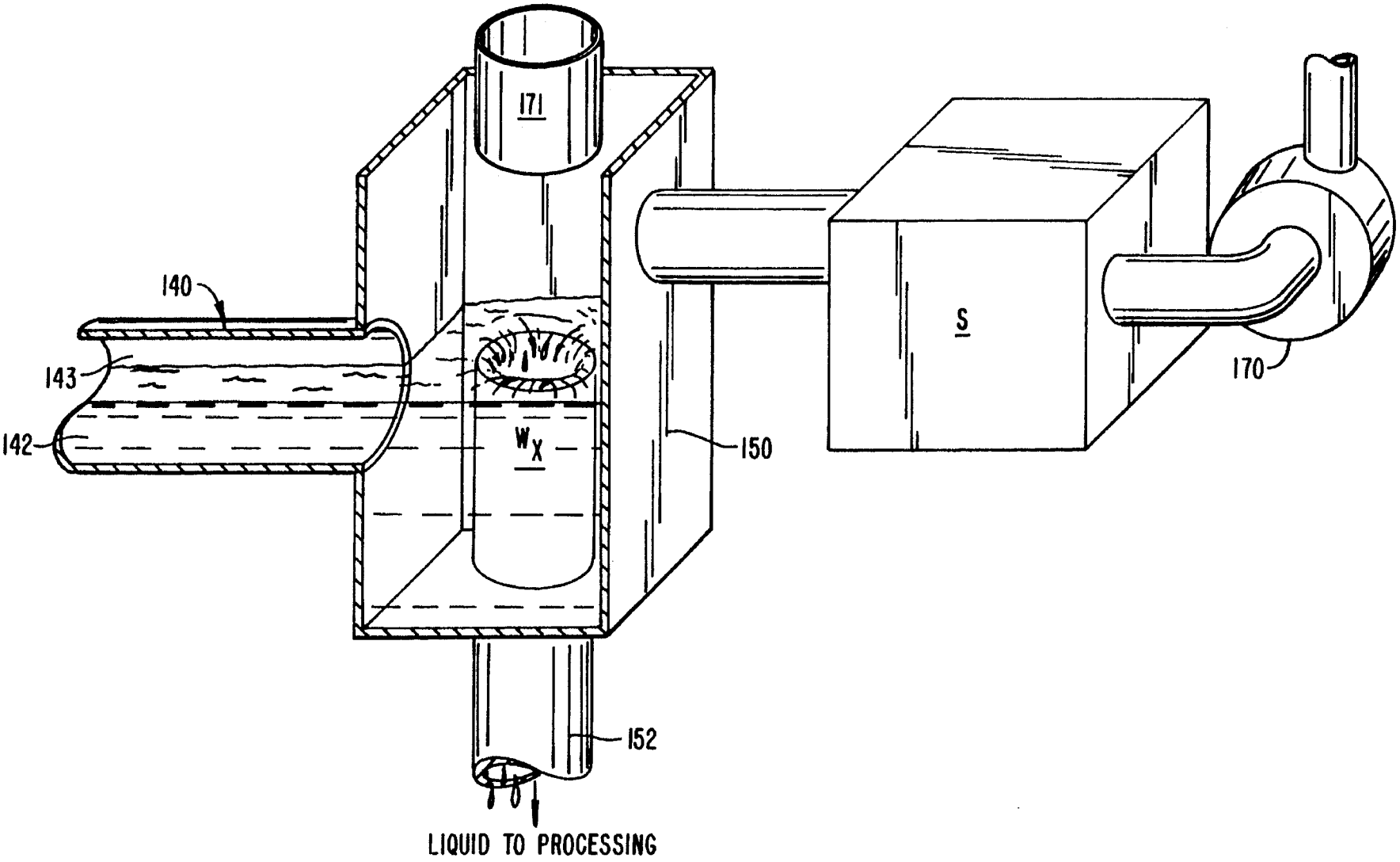

Referring to FIG. 10, collection manifold 140 is shown at its discharge end. Discharge occurs to circular weir $W_x$ within sump 150. The electrolyte drains to a tank (not shown) through line 152 for further processing.

Referring to FIG. 10, induced or forced draft blower 170 causes extracted gases to pass through scrubber S for conventional removal of the acid mist aerosol. Thus, mechanism for the forced evacuation of gas is illustrated from collection manifold 140. Additional venting of gases can occur through upward vent 171.

We illustrate induced or forced draft blower 170 only schematically knowing that various other devices for pumping gas may well be required. As of this writing, this invention through experiment is known to function in the case of a single experimental cell. We recognize that once this device is expanded to a large commercial tank house containing many tanks (for example up to 800 tanks), other expedients may well have to be used in the exhaust of gas from common collection manifolds utilized and schematically illustrated herein.

It is to be understood that it is now known that air entrainment is sufficient to extract gas from a single plenum P from under multi-component roof system R. It will be understood that additional problems may be encountered where an entire tank house having multiple tanks T is encountered. For example, assuming that 400 tanks T in a single tank house all relied on downcomers 130, it may well be that positive pressure could develop in upper half 143 of collection manifold 140. This being the case, provision along the lines of that suggested in FIG. 10 may have to be provided periodically along collection manifolds 140.

What is claimed is:

1. An acid mist collection system for gas and mist generation in a tank confined electrowinning process having electrolyte bath with circulating electroplating solution containing acid passing between side-by-side planar anode electrodes and cathode electrodes in an array between tank sides, each electrode having electrical connections above a surface of the electrolyte bath, the acid mist collection system comprising:

a multi-element cover system applied below the electrical connections and above the surface of the electrolyte bath including a plurality of flexible electrode caps fastened to at least one side of the electrodes and spanning to adjacent electrodes to form a continuous, substantially air tight cover over the solution;

means for covering the circulating electroplating solution from the electrodes to the sides of the tank above the surface of the circulating electroplating solution for forming a substantially air tight seal; and means for evacuating that volume below the multi-element cover system and above the path at a rate exceeding the rate of the gas and mist generation to create a negative pressure in the volume whereby any leakage that occurs into the volume overlying the bath and underlying the multi-element cover system into the volume below the multi-element cover system thereby preventing acid mist form escape to the atmosphere.

2. The acid mist collection system of claim 1 wherein:

the electrode caps are fastened to the anode electrodes.

3. The acid mist collection system of claim 1 wherein:

the electrode caps include flexible tapered eaves having sufficient span to form a substantially air tight seal between adjacent electrodes and sufficient flexibility to permit insertion and removal of the electrodes.

4. The acid mist collection system of claim 1 wherein:

the electrode caps define on the circulating electroplating solution exposed side thereof means for causing acid incidentally coalesced to drip into the circulating electroplating solution away from adjoining electrodes.

5. The acid mist collection system of claim 1 wherein:

the means for covering the circulating electroplating solution from the electrodes to the sides of the tank above the surface of the acid solution for forming a substantially air tight seal includes:

flexible acid inert members fastened between the flexible electrode caps and the sides of the tank having a sufficient dimension to overlap one another.

6. The acid mist collection system of claim 1 wherein:

the means for evacuating that volume below the multi-element cover system and above the circulating electroplating solution at a rate exceeding the rate of gas and mist generation includes a ventilation exhaust communicated to the volume between the multi-element cover system and the sides of the tank.

7. The acid mist collection system of claim 1 wherein:

the means for evacuating that volume below the multi-element cover system and above the circulating electroplating solution includes means for evacuating at a rate of about ten times the stoichiometric rate of gas generation.

8. The acid mist collection system of claim 1 wherein the means for evacuating that volume below the multi-element cover system and above the circulating electroplating solution includes:

means for evacuating that volume below the multi-element cover system and above the circulating electroplating solution includes energy actuated means for extraction of the acid mist.

9. The acid mist collection system of claim 8 wherein:

the energy actuated means for extraction of the acid mist includes an acid bath scrubber.

10. Method for acid mist collection for use in a tank having sides confining an electrowinning process having an electrolyte bath containing an electroplating solution containing circulated acid solution passing between side-by-side planar anode electrodes and cathode electrodes in an array, each electrode having electrical connections above a surface of the electrolyte bath, the acid mist collection method comprising the steps of:

providing a multi-element cover system applied below the electrical connections and above the surface of the electrolyte bath;

providing a plurality of flexible electrode caps having sufficient dimension to span to adjacent electrodes;

fastening the electrode caps to at least one side of the electrodes at a location permitting the caps to span to adjacent electrodes to form a continuous, substantially air tight cover over the electrolyte bath;

providing means for covering the circulated acid solution from the electrodes to the sides of the tank above the surface of electrolyte solution for forming a substantially air tight seal; and, evacuating a volume below the multi-element cover system and above the bath at a rate exceeding a rate of gas and mist generation to create a negative pressure in the volume whereby any atmosphere leakage that occurs into the volume below the multi-element cover system and above the bath occurs from above the multi-element cover system into the volume below the multi-element cover system thereby preventing acid aerosol from escape.

11. The acid mist collection method of claim 10 including the further step of:

fastening the electrode caps the anodes.

12. The acid mist collection method of claim 10 wherein:

the provided plurality of flexible electrode caps include flexible tapered eaves having sufficient span to form a substantially air tight seal between the electrodes and sufficient flexibility to permit insertion and removal of the electrodes.

13. The acid mist collection method of claim 10 including the step of:

defining on a bath exposed side of the electrode caps means for causing coalesced acid to drip into the bath away from adjoining electrodes.

14. The acid mist collection method of claim 10 wherein:

the provided means for covering the circulated acid solution from the electrodes to the sides of the tank above the surface of the acid solution for forming a substantially air tight seal includes:

providing flexible acid inert members fastened between the electrode caps and the tank sides, the flexible acid inert member having a sufficient dimension to overlap one another between the electrode caps and having a sufficient dimension to overlap the tank sides.

15. The acid mist collection method of claim 10 wherein:

evacuating the volume below the multi-element cover system and above the bath at a rate exceeding the rate of gas and mist generation includes the step of:

evacuating that volume below the multi-element cover system and above the bath with energy actuated means for extraction of the acid mist.

16. The acid mist collection method of claim 10 wherein:

evacuating the volume below the multi-element cover system and above the bath step includes evacuating at a rate of about ten time the stoichiometric rate of gas and mist generation.

17. The acid mist collection method of claim 10 wherein the step of evacuating the volume below the multi-element cover system and above the bath at a rate exceeding the rate of gas and mist generation includes:

providing energy actuated extraction means for removing acid mist; and, communicating the volume below the multi-element cover system and above the bath to energy actuated means for extraction of the acid mist to remove the acid mist.

18. The acid mist collection method of claim 17 wherein:

the providing energy actuated means for extraction of the acid mist includes providing an acid bath scrubber.

19. In a multi-element cover system applied below electrode connections and above a surface of a bath in an electrowinning process having circulated acid electroplating solution containing acid passing between side-by-side planar anode electrodes and cathode electrodes in an array, each electrode having electrical connections above the surface of the bath, the multi-element cover system comprising:

a plurality of flexible electrode caps fastened to at least one side of the anode electrodes below the electrical connection thereto and above the bath, the flexible electrode caps having an underside exposed to the bath;

each said flexible electrode caps having sufficient dimension to span to adjacent cathode electrodes to form a continuous, substantially air tight cover between the electrodes of the electrode array;

the underside of the cap having a first slope having a high end of the slope at a cathode and a low end of the slope at an anode whereby coalesced acid is substantially prevented from passing from the underside of the caps to an adjacent cathode; and, means for preventing the coalesced acid from running along the underside of the flexible electrode caps whereby during insertion of the cathodes, the coalesced acid is substantially prevented from passing from the underside of the caps to an adjacent cathode during flexure of the caps producing a second slope reversed to the first slope at the underside exposed to the bath toward the cathodes.

20. The multi-element cover system of claim 19 and wherein the means for preventing the coalesced acid from running along the underside of the flexible electrode caps acid to adjacent electrodes includes:

a continuous ridge on the underside exposed to the bath parallel to the surface of the electrode.

21. The multi-element cover system of claim 19 and wherein each flexible electrode cap further includes:

a dual hardness plastic extrusion including a first rigid portion of the cap for fastening to the electrode and a second flexible and tapered portion of the cap for spanning away from the electrode to and toward adjacent electrodes.

22. In an electrowinning apparatus side-by-side planar anode electrodes and cathode electrodes in an array, each electrode having electrical connections above a surface of an electrolyte bath, an improved electrode comprising:

means for depending support of the electrodes into the electrolyte bath;

means for supplying sufficient current to the electrode to cause electroplating to occur between a plurality of the electrodes;

a plurality of flexible electrode caps fastened to at least one side of the anode electrodes below the electrical connection-thereto and above the bath, each said flexible electrode caps having sufficient dimension to span to adjacent cathode electrodes to form a continuous, substantially air tight cover between the electrodes of the electrode array, the flexible electrode having an underside exposed to the bath;

the underside of the cap having a first slope having the high end of the slope at a cathode and the low end of the slope at an anode whereby the coalesced acid is substantially prevented from passing from the underside of the caps to an adjacent cathode; and, means for preventing coalesced acid from running along the underside of the flexible electrode caps whereby during insertion of the cathodes, the coalesced acid is substantially prevented from passing from the underside of the caps to an adjacent cathode during flexure of the caps producing a second slope reversed to the first slope at the underside exposed to the bath toward the cathodes.

23. The improved electrode of claim 22 and wherein the means for preventing coalesced acid from running along the underside of the flexible electrode caps to adjacent electrodes includes:

a continuous ridge on the underside of the cap parallel to the surface of the electrode.

24. The improved electrode of claim 22 and wherein each flexible electrode cap further includes:

a dual hardness plastic extrusion including a first rigid portion of the cap for fastening to the electrode and a second flexible and tapered portion of the cap for spanning away from the electrode to and toward adjacent electrodes.

25. An acid mist aerosol collection system for use in a tank having sides to confine an electrowinning process having an electrolyte bath with an electroplating solution containing circulating acid passing between side-by-side planar anode electrodes and cathode electrodes in an array, each electrode having electrical connections above a surface of the electrolyte bath, the acid mist aerosol collection system comprising:

a multi-element cover system applied below the electrical connections and above the surface of the electrolyte bath including a plurality of flexible electrode caps fastened to at least one side of the electrodes and spanning to adjacent electrodes to form a continuous, substantially air tight cover over the solution;

means for covering the circulating acid from the electrodes to the sides of the tank above the surface of the circulating acid for forming a substantially air tight seal; and, means for evacuating a volume below the cover system and above the bath at a rate exceeding a rate of gas and mist generation to create a negative pressure in the volume whereby any atmosphere leakage that occurs into the volume overlying the bath and underlying the multi-element cover occurs from above the multi-element cover into the space below the multi-element cover thereby preventing acid aerosol from escape to the atmosphere;

the means for evacuating operating at a rate to maintain humidity under the multi-element cover system for retarding evaporation under the cover from the acid mist aerosol.

26. The acid mist aerosol collection system of claim 25 wherein:

the electrode caps are fastened to the anodes.

27. The acid mist aerosol collection system of claim 25 wherein:

the electrode caps include flexible tapered eaves having sufficient span to form a substantially air tight seal between adjacent electrodes and sufficient flexibility to permit insertion and removal of the electrodes.

28. The acid mist aerosol collection system of claim 25 wherein:

the electrode caps define on a bath exposed side thereof means for causing acid incidentally coalesced to drip into the bath away from adjoining electrodes.

29. The acid mist aerosol collection system of claim 25 wherein:

the means for covering the circulating acid from the electrodes to the sides of the tank above the surface of the acid solution for forming a substantially air tight seal includes:

flexible acid inert members fastened between the ends of the electrode caps and the tank sides, the flexible acid inert members having a sufficient dimension to overlap one another between the electrode caps and having a sufficient dimension to overlap the tank sides.

30. The acid mist aerosol collection system of claim 25 wherein:

the means for evacuating the volume below the cover and above the bath at a rate exceeding the rate of gas and mist generation includes a ventilation exhaust communicated to the volume between the multi-element tank cover at the tank ends.

31. The acid mist aerosol collection system of claim 25 wherein:

the means for evacuating the volume below the cover and above the bath at a rate includes means for evacuating the volume at a rate of about ten times the stoichiometric rate.

32. The acid mist aerosol collection system of claim 25 wherein the means for evacuating the volume below the cover and above the bath at a rate exceeding the rate of gas and mist generation includes:

means communicating the evacuated volume for extraction of the acid mist aerosol includes energy actuated extraction means.

33. The acid mist aerosol collection system of claim 32 wherein:

the means for evacuating the acid mist aerosol includes an acid bath scrubber.

34. Method for acid mist collection for use in a tank confined electrowinning process having an electrolyte bath with electroplating solution containing circulating acid passing between side-by-side planar anode electrodes and cathode electrodes in an array, each electrode having electrical connections above a surface of the electrolyte bath, the acid mist collection system comprising in combination:

providing a multi-element cover system applied below the electrical connections and above the surface of the electrolyte bath including a plurality of flexible electrode caps having sufficient dimension to span to adjacent electrodes;

fastening the electrode caps to at least one side of the electrodes at a location permitting the caps to span to adjacent electrodes to form a continuous, substantially air tight cover over the electrolyte bath;

providing means for covering the circulating acid from the electrodes to the sides of the tank above the surface of the circulating acid for forming a substantially air tight seal; and, evacuating a volume below the cover system and above the bath at a rate exceeding a rate of gas and mist generation to create a negative pressure in the volume whereby any leakage that occurs into the volume overlying the bath and underlying the multi-element cover system occurs from above the multi-element cover system into the volume below the multi-element cover system thereby preventing acid aerosol from escape, the evacuating restricted to at a rate to maintain humidity under the multi-element cover system for retarding evaporation under the multi-element cover system from the acid mist aerosol.

35. The acid mist collection method of claim 34 including the further step of:

fastening electrode cap to the anodes.

36. The acid mist collection method of claim 34 wherein:

the provided multi-element cover systems includes flexible tapered eaves having sufficient span to form a substantially air tight seal between the electrodes and sufficient flexibility to permit insertion and removal of the electrodes.

37. The acid mist collection method of claim 34 including the step of:

defining on the bath exposed side of the electrode caps means for causing coalesced acid to drip into the bath away from adjacent electrodes.

38. The acid mist collection method of claim 34 wherein:

the provided multi-element cover system above the surface of the acid solution for forming a substantially air tight seal includes:

providing flexible acid inert members fastened between the ends of the electrode caps and the tank sides, the flexible acid inert member having a sufficient dimension to overlap one another between the electrode caps and having a sufficient dimension to overlap the tank sides.

39. The acid mist collection method of claim 34 wherein:

evacuating the volume below the multi-element cover system and above the bath at a rate exceeding the rate of gas and mist generation includes the step of:

communicating a ventilation exhaust to an acid mist scrubber.

40. The acid mist collection method of claim 39 wherein:

the evacuating of the volume below the cover and above the bath step includes evacuating at a rate includes means for evacuating the volume at a rate of about ten times the stoichiometric rate.

41. The acid mist collection method of claim 34 wherein the means for evacuating the volume below the cover and above the bath at a rate exceeding the rate of gas and mist generation includes:

providing energy actuated extraction means for removing acid mist; and, communicating the evacuated volume to the energy actuated means for extraction of the acid mist to remove the acid mist.

42. The acid mist collection method of claim 41 wherein:

the providing energy actuated means for extraction of the acid mist includes providing an acid bath scrubber.

43. In the combination of:

a tank for containing electroplating solution for electroplating;

anode and cathode electrodes within the tank and having electrical connections above the surface of the electroplating solution communicated to a source of current for causing electroplating within the tank;

an outlet for discharging the electroplating solution from the tank;

a cover over the tank and outlet; and, means for evacuation of gas and mist resulting from the electroplating from a plenum under the cover and over the bath, the cover and means for the evacuation of gas and mist comprising:

the cover including:

a multi-element cover system applied below the electrical connections and above the surface of the electroplating solution including a plurality of flexible electrode caps fastened to at least one side of the electrodes and spanning to adjacent electrodes to form a continuous, substantially air tight cover over the solution;

means for covering the circulating electroplating solution from the electrodes to the sides of the tank above the surface of the circulating electroplating solution for forming a substantially air tight seal;

the means for the evacuation of gas and mist including:

at least one weir for discharging the electroplating solution to at least one pipe; and, the weir in combination with the pipe having sufficient flow volume for receiving the outflow of electroplating solution from the tank and gas and mist from the plenum.

44. In the combination of claim 43 and wherein:

the weir is a circular weir.

45. In the combination of claim 43 and wherein:

the pipe comprises a downcomer.

46. In the combination of claim 43 and wherein:

means for evacuation of gas is communicated to the weir.

47. In the combination of claim 46 and wherein:

the means for evacuation of gas includes fluid flow down the pipe.

48. In the combination of claim 46 and wherein:

the means for evacuating gas includes means for impelling gas communicated to the pipe.

49. In combination:

a tank having sides for containing electroplating solution;

anode and cathode electrodes within the tank and having electrical connections communicated to a source of current for causing electroplating within the tank;

a multi-element cover system applied below the electrical connections and above a surface of the electroplating solution including a plurality of flexible electrode caps fastened to at least one side of the electrodes and spanning to adjacent electrodes to form a continuous, substantially air tight cover over the solution;

means for covering the circulating electroplating solution from the electrodes to the sides of the tank above the surface of the circulating electroplating solution for forming a substantially air tight seal; and, an outlet for discharging electroplating solution from the tank, the outlet including at least one weir for discharging the electroplating solution to a pipe; and, the at least one weir in combination with the pipe having sufficient flow volume for receiving the outflow of electroplating solution from the tank and gas and mist from the plenum.

50. The combination of claim 49 and further including:

means for evacuation of gas and mist resulting from the electroplating from a plenum under the cover and over the bath, the means communicated to the pipe.

51. The combination of claim 50 and further including:

the means for evacuation of gas and mist includes induced flow of gas by liquid electrolyte passing over the weir and flowing down the pipe.

52. The combination of claim 49 and further including:

an inlet under the cover communicated to the tank for in letting electrolyte to replace electrolyte passing over the weir.

53. A method for evacuating aerosol acid mist from a tank having electroplating solution within the tank and having electroplating occurring between anode and cathode electrodes having electrical connections for producing plated metal and gas rising to the surface of the bath in the tank, the gas rising in the tank causing gas and mist aerosols over the surface of the tank, the method comprising the steps of:

placing a cover over the electrodes, the cover including a multi-element cover system applied below the electrical connections and above the surface of the electrolyte bath including a plurality of flexible electrode caps fastened to at least one side of the electrodes and spanning to adjacent electrodes to form a continuous, substantially air tight cover over the solution;

covering the circulating electroplating solution from the electrodes to the sides of the tank above the surface of the circulating electroplating solution for forming a substantially air tight seal;

providing the tank with at least an outflow for circulating electroplating solution through the tank;

providing the tank with a weir at the outflow;

out flowing fluid from the tank over the weir; and, drawing gas and mist aerosol over the weir below the cover and above the surface of the electrolyte for causing the gas and mist to exit the tank and be drawn over the weir to avoid the formation of crystals adjacent the weir.

54. A method for evacuating aerosol acid mist from a tank having electroplating solution within the tank and having electroplating occurring between anodes and cathodes for producing plated metal and gas rising to the surface of the bath in the tank, the gas rising in the tank causing gas and mist aerosols over the surface of the tank according to claim 53 and including the further steps of:

providing the tank with a circular weir at the outflow.

55. A method for evacuating aerosol acid mist from a tank having electroplating solution within the tank and having electroplating occurring between anodes and cathodes for producing plated metal and gas rising to the surface of the bath in the tank, the gas rising in the tank causing gas and mist aerosols over the surface of the tank according to claim 53 and including the further steps of:

drawing the gas and mist over the weir to a pipe communicated to the weir.

56. A method for evacuating aerosol acid mist from a tank having electroplating solution within the tank and having electroplating occurring between anodes and cathodes for producing plated metal and gas rising to the surface of the bath in the tank, the gas rising in the tank causing gas and mist aerosols over the surface of the tank according to claim 55 and including the further steps of:

communicating the weir to a pipe downcomer;

utilizing the flow of liquid in the downcomer to induce air for drawing the air over the weir.

57. An acid mist collection system for use in a tank confined electrolysis process having electrolyte electroplating solution containing acid passing between side-by-side planar anode electrodes and cathode electrodes in an array, each electrode having electrical connections above the surface of the electrolyte bath, said acid mist collection system comprising:

a multi-element cover system applied below the electrode connections and above the surface of the electrolyte bath including a plurality of flexible electrode caps spanning between adjacent electrodes to form a continuous, substantially air tight cover over said solution;

means for covering said circulated acid solution from the electrodes to the sides and ends of the tank above the surface of the acid solution for forming a substantially air tight seal; and, means for evacuating the volume below the cover and above the bath at a rate exceeding the rate of gas and mist generation to create a negative pressure in said volume whereby any atmosphere leakage that occurs into the volume overlying the bath and underlying the multi-element cover occurs from above said multi-element cover thereby preventing acid aerosol from escape to the atmosphere.

58. An acid mist collection system for use in a tank confined electrolysis process according to claim 57 and wherein:

said multi-element cover systems is attached to said electrodes.

* * * * *